US012416161B2

(12) United States Patent
Barnds

(10) Patent No.: US 12,416,161 B2
(45) Date of Patent: Sep. 16, 2025

(54) BALUSTER CONNECTORS AND SYSTEMS HAVING THE SAME

(71) Applicant: The AZEK Group LLC, Chicago, IL (US)

(72) Inventor: Patrick Michael Barnds, Birmingham, MI (US)

(73) Assignee: The AZEK Group LLC, Chicago, IL (US)

( * ) Notice: Subject to any disclaimer, the term of this patent is extended or adjusted under 35 U.S.C. 154(b) by 188 days.

(21) Appl. No.: 17/592,050

(22) Filed: Feb. 3, 2022

(65) Prior Publication Data

US 2022/0243477 A1 Aug. 4, 2022

Related U.S. Application Data

(60) Provisional application No. 63/145,574, filed on Feb. 4, 2021.

(51) Int. Cl.
*E04F 11/18* (2006.01)

(52) U.S. Cl.
CPC ..... *E04F 11/1817* (2013.01); *E04F 11/1842* (2013.01); *E04F 2011/1821* (2013.01)

(58) Field of Classification Search
CPC . E04F 11/181; E04F 11/1817; E04F 11/1842; E04F 2011/1823; E04F 2011/1825; E04F 2011/1827
See application file for complete search history.

(56) References Cited

U.S. PATENT DOCUMENTS 4,403,767 A * 9/1983 Basey ..... E04F 11/1834 403/294
4,898,365 A * 2/1990 Conner ..... E04F 11/1844 256/65.12
6,719,278 B2 * 4/2004 Bryan ..... E04F 11/181 256/65.01
6,889,960 B1 * 5/2005 Jones ..... E04F 11/1834 411/510
7,044,448 B1 * 5/2006 Jones ..... E04F 11/181 256/65.01
7,762,533 B2 * 7/2010 DeRogatis ..... E04F 11/181 256/22
8,282,083 B1 10/2012 Poma
9,206,953 B2 * 12/2015 Roos ..... F21V 33/006
9,556,641 B2 * 1/2017 Milanowski ..... E04F 11/1842
(Continued)

FOREIGN PATENT DOCUMENTS

EP 2003265 A2 * 12/2008 ..... E04F 11/1817
GB 2294065 A * 4/1996 ..... B23B 47/28
(Continued)

OTHER PUBLICATIONS

International Search Report and Written Opinion received for PCT Patent Application No. pct/us2022/015290, mailed on Apr. 26, 2022, 9 pages.
(Continued)

*Primary Examiner* — Jonathan P Masinick
(74) *Attorney, Agent, or Firm* — Shook, Hardy & Bacon L.L.P.

(57) ABSTRACT

Baluster connectors and railing systems utilizing baluster connectors. The baluster connectors can include a baluster engaging portion, a support engaging portion, and a flange.

7 Claims, 13 Drawing Sheets

(56) References Cited

U.S. PATENT DOCUMENTS

| | | | | |
|---|---|---|---|---|
| 10,060,136 | B2 * | 8/2018 | Milanowski | E04F 11/1817 |
| 10,316,523 | B2 * | 6/2019 | Yu | E04F 11/1817 |
| 10,604,941 | B2 * | 3/2020 | Schneider | E04F 11/1836 |
| 2004/0177586 | A1 | 9/2004 | McLean | |
| 2009/0173926 | A1 | 7/2009 | Timothy | |
| 2009/0200532 | A1 * | 8/2009 | Platt | E04F 11/1834 256/67 |
| 2009/0272957 | A1 * | 11/2009 | Nelson | E04F 11/1834 256/65.01 |
| 2011/0073824 | A1 * | 3/2011 | Lappin | E04F 11/1836 29/428 |
| 2011/0248232 | A1 * | 10/2011 | Leary | E04F 11/1842 256/65.01 |
| 2015/0115214 | A1 | 4/2015 | Schneider et al. | |
| 2015/0252570 | A1 * | 9/2015 | Springborn | E04H 17/1417 52/832 |
| 2016/0160525 | A1 | 6/2016 | Milanowski | |
| 2020/0040587 | A1 * | 2/2020 | Yu | E04F 11/1812 |

FOREIGN PATENT DOCUMENTS

| | | | | |
|---|---|---|---|---|
| KR | 20110105630 | A | * | 9/2011 |
| KR | 20130030929 | A | * | 3/2013 |

OTHER PUBLICATIONS

International Preliminary Report on Patentability received for PCT Application No. PCT/US2022/015290, mailed on Aug. 17, 2023, 7 pages.

Extended European Search Report issued in European Application No. 22750456.0, mailed on Nov. 20, 2024, 8 pages.

* cited by examiner

BALUSTER CONNECTORS AND SYSTEMS HAVING THE SAME

CROSS-REFERENCE TO RELATED APPLICATIONS

This application claims priority to U.S. provisional application No. 63/145,574, filed on Feb. 4, 2021, entitled: "BALUSTER CONNECTORS AND SYSTEMS HAVING THE SAME." The entirety of the aforementioned application is incorporated by reference herein.

TECHNICAL FIELD

The present disclosure relates to baluster connectors and/or to systems that utilize the baluster connectors.

BACKGROUND

Certain conventional railing systems utilize baluster coupling components that require the use of a separate fastener to secure the coupling component to a rail and/or to a baluster. However, such systems can require additional or specialized tools to install, and can require additional installation steps that may result in installation errors and/or a longer or more complicated installation process.

BRIEF DESCRIPTION OF THE DRAWINGS

Illustrative aspects are described in detail below with reference to the attached drawing figures, which are incorporated by reference herein and wherein.

DESCRIPTION

Figure 1:
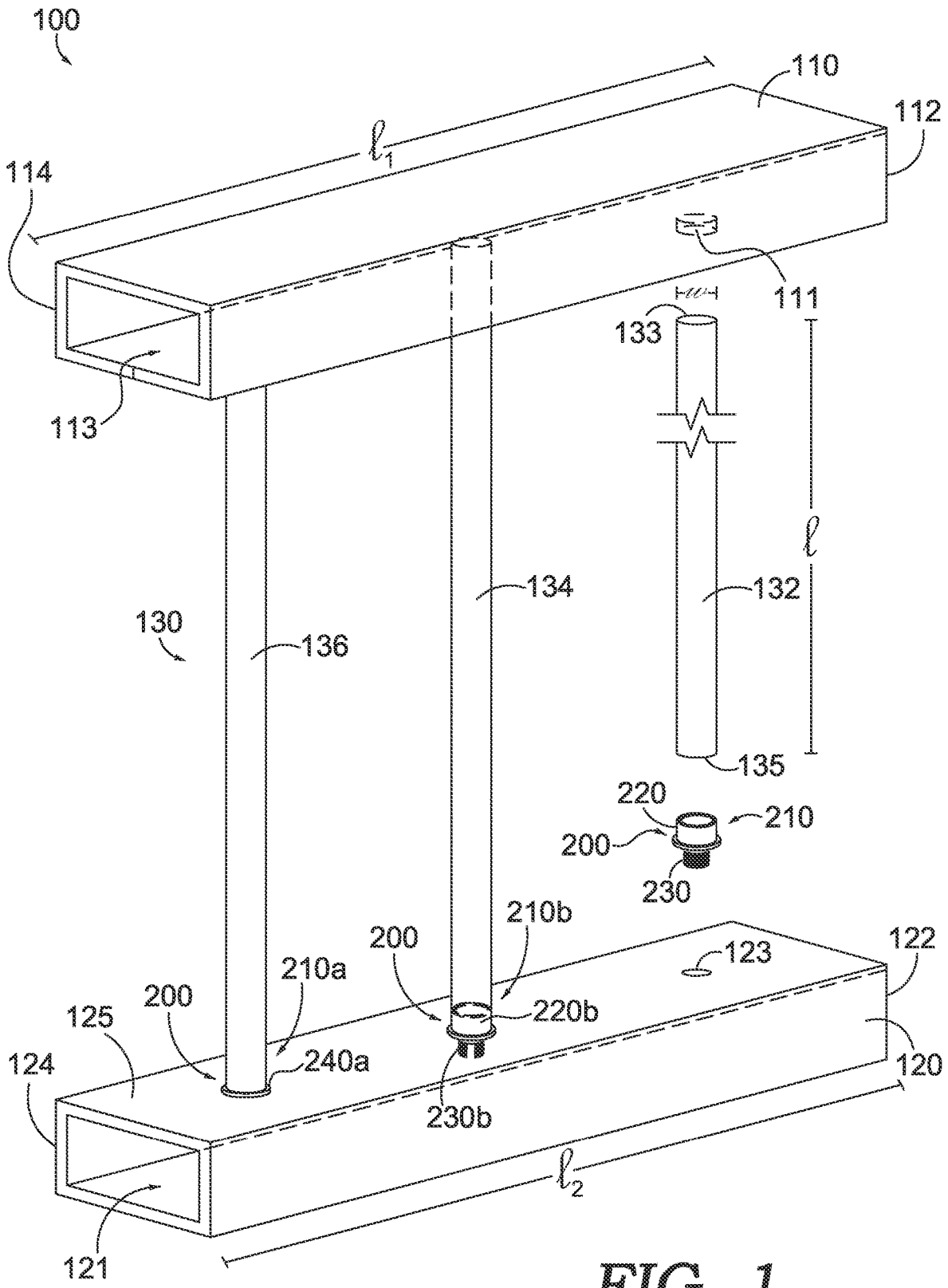
FIG. 1 depicts an example railing system, in accordance with aspects hereof.

Aspects herein relate to baluster connecters. Additional aspects herein relate to systems that utilize baluster connectors for coupling a baluster to one or more supports, e.g., a rail. As discussed above, certain conventional baluster coupling components can require the use of a separate fastener to secure the coupling component to a rail and/or to a baluster. However, such conventional systems can require additional or specialized tools to install, and can require additional installation steps. There is a need for baluster connectors that do not require additional fasteners or other components to couple a baluster to a rail, and/or that offer ease of installation.

The baluster connectors and railing systems disclosed herein can alleviate one or more of the problems described above. For instance, in aspects, the baluster connectors disclosed herein can include a baluster engaging portion that can be coupled to a baluster, e.g., inserted into the baluster, and a support engaging portion that can be coupled to a support, e.g., inserted into a void in a support and/or a rail. In such aspects, the baluster connectors disclosed herein can be secured to a support and to the baluster without the use of additional separate fasteners or specialized tools, thereby allowing for ease of installation.

Accordingly, in one aspect a baluster connector is provided. The baluster connector can include a first end and a second end opposite the first end. The baluster connector can also include a flange positioned between the first end and the second end. The baluster connector can further include a baluster engaging portion, where the baluster engaging portion extends out from the flange to the first end. The baluster connector can also include a support engaging portion, where the support engaging portion extends out from the flange to the second end.

In yet another aspect, a railing system is provided. The railing system can include a top rail, the top rail extending from a first end to a second end; and a bottom rail, the bottom rail extending from a first end to a second end, where the bottom rail is vertically spaced apart from the top rail. The railing system can also include one or more balusters, each of the one or more balusters including a first end and a second end. The railing system can also include one or more baluster connectors. The one or more baluster connectors are adapted for coupling to: i) the second end of one of the one or more balusters; and ii) the bottom rail. Each of the one or more balusters includes a first end and a second end opposite the first end. Each of the one or more baluster connectors can also include a flange positioned between the first end and the second end. Each of the one or more baluster connectors can further include a baluster engaging portion, where the baluster engaging portion extends out from the flange to the first end. Each of the one or more baluster connectors can also include a support engaging portion, where the support engaging portion extends out from the flange to the second end.

As used herein, the term "about" means plus or minus 10% of the numerical value of the number with which it is being used unless otherwise indicated or custom in the art dictates otherwise. Therefore, for example, "about 10 millimeters (mm)" includes the value 10 mm in addition to the range of 9 mm to 11 mm.

Turning to the figures, and FIG. 1 in particular, an example railing system 100 is depicted. While the railing system 100 is depicted as a level railing system, it should be understood that other types of railing systems are also contemplated for use with the systems disclosed herein, including but not limited railing systems for installation on an angled surface, e.g., slopes and/or stairways.

The railing system 100 depicted in FIG. 1 includes a top rail 110 and a bottom rail 120, a plurality of balusters 130, and a plurality of baluster connectors 200. As can be seen in the aspect depicted in FIG. 1, the top rail 110 and the bottom rail 120 can be vertically spaced apart, with the plurality of balusters 130 extending between the top rail 110 and the bottom rail 120. As will be discussed below in more detail, each of the plurality of baluster connectors 200 can couple one end of a baluster to the bottom rail 120 or other support. In an aspect not depicted in FIG. 1, the baluster connectors disclosed herein can be utilized to couple a baluster to a top rail, e.g., the top rail 110, in addition to a baluster connector being utilized to couple a baluster to a bottom rail, e.g., the bottom rail 120, or instead of utilizing a baluster connector to couple a baluster to a bottom rail.

It should be understood that, as used herein, the terms top rail and bottom rail may not exclusively refer to a top-most rail and a bottom-most rail, respectively, of a railing system. Rather, in certain aspects, a baluster may extend between a top rail and a bottom rail, where such a top rail and/or such a bottom rail is an intermediate rail in a railing system. For instance, in one specific example, a railing system may include a bottom rail (or other bottom support), a top rail, and an intermediate rail positioned between the top and bottom rails. In such an example, a baluster may be coupled to the bottom rail (or other bottom support) and the intermediate rail. In this example, the intermediate rail may also be referred to as a top rail. In another example, a baluster may be coupled to a top rail and to an intermediate rail, with a bottom rail positioned beneath the intermediate rail. In such an example, the intermediate rail may be referred to as a bottom rail. In yet another example, a baluster may be coupled to two intermediate rails with top and bottom rails positioned on either side of the two intermediate rails. In such an example, the two intermediate rails coupled to the baluster may be referred to as top and bottom rails. Accordingly, while in aspects, the terms top rail and bottom rail may be utilized, it should be understood that the terms top rail and bottom rail may refer to the rails with which the opposing ends of the baluster may be coupled to, which may not necessarily be the top-most and bottom-most rails of a railing system. Further, as discussed above, the disclosure herein also contemplates that a baluster connector can be utilized to connect a baluster to a support other than a bottom rail. In one or more aspects, the support structure can be a floor, ground, step, ramp, or the like, and in such an aspect, a baluster connecter, e.g., via a support engaging portion, can interact with a void or aperture in such a support structure in a manner similar to that described herein with respect to a bottom rail.

In aspects, any or all of the components of the railing system 100 can be comprised of metal, including but not limited to iron, steel, and/or aluminum; polymeric material; wood; filler material; or a combination thereof.

In the aspect depicted in FIG. 1, the top rail 110 extends between a first end 112 and a second end 114 in a direction that is the same or similar to the direction of extension between a first end 122 and a second end 124 of the bottom rail 120, when the railing system is in an assembled configuration. In the same or alternative aspects, when assembled, the top rail 110 and the bottom rail 120 can be parallel or substantially parallel with one another. As used herein, a railing system in an assembled configuration can refer to a baluster being coupled to a top rail, e.g., the top rail 110, and to the bottom rail, e.g., the bottom rail 120, as depicted in FIG. 1 for the baluster 136, including the use of a baluster connector, e.g., the baluster connector 210*a*, to couple the baluster 136 to the bottom rail 120.

In various aspects, such as that depicted in FIG. 1, the top rail 110 and/or the bottom rail 120 can include a void 113 or 121, respectively, extending through at least a portion of the top rail 110 and/or the bottom rail 120. In one aspect, the void 113 and/or the void 121 can extend through the length $l_1$ of the top rail 110 and/or the length $l_2$ of the bottom rail 120, respectively. In aspects, the voids 113 and/or 121 can provide space for the insertion of the respective portions of the baluster and baluster connectors, respectively, as discussed below.

In an alternative aspect, the top rail 110 and/or the bottom rail 120 can be solid or partly solid components, e.g., do not include a void 113 and/or a void 121 that extends through the length $l_1$ of the top rail 110 and/or the length $l_2$ of the bottom rail 120, respectively. In such an aspect, the top rail 110 and/or bottom rail 120 can include discrete voids for receiving respective portions of the baluster and/or baluster connectors, such as the aperture 111 and associated void shown in phantom in the top rail 110 for receipt of a portion of the baluster 132.

As can be seen in FIG. 1, the plurality of balusters 130 are depicted as having a cylindrical shape and/or exhibit a circular cross-sectional shape in a plane transverse to their length, l. It should be understood that the plurality of balusters can be any shape, including a shape exhibiting a square or rectangular cross-sectional shape. In aspects, the plurality of balusters 130 can exhibit a length l of between about 30 centimeters (cm) and about 150 cm. In the same or alternative aspects, the plurality of balusters can exhibit a width w of between about 2.5 millimeters (mm) to about 110 mm, from about 5 mm to about 80 mm, from about 6 mm to about 65 mm, or from about 7 mm to about 50 mm.

In certain aspects, as can be seen in FIG. 1, a first end 133 of the baluster 132 can be inserted into an aperture 111 of the top rail 110 and allowing the first end 133 of the baluster 132 to extend into the void 113. In the same or alternative aspects, the second end 135 of the baluster 132 can be coupled to the bottom rail 120 via the baluster connector 210. In aspects, a baluster engaging portion 220 of the baluster connector 210 can be inserted into a void at or near the second end 135 of the baluster 132, and the support engaging portion 230 of the baluster connector 210 can be inserted into an aperture 123 of the bottom rail 120, thereby coupling the baluster 132 to the bottom rail 120. As can be seen in FIG. 1, the baluster connector 210*b* includes a baluster engaging portion 220*b* inserted into the baluster 134 while the support engaging portion 230*b* is inserted into the bottom rail 120, e.g., extending into the void 121. As discussed further below, with reference to FIG. 11, in certain aspects, the baluster connectors disclosed herein, may be utilized to secure a baluster to a top rail in addition to, or instead of, a bottom rail.

Figure 2C:
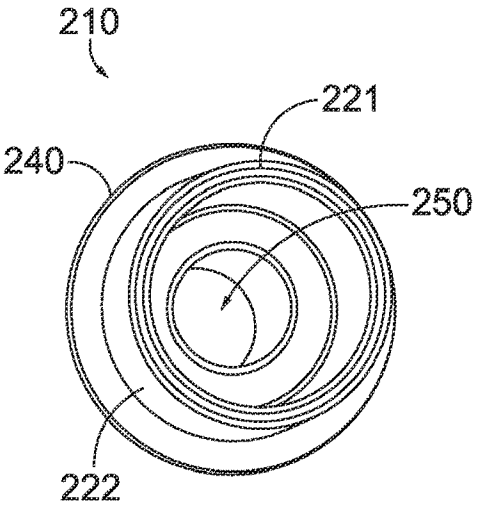
FIGS. 2A-2C depict an example baluster connecter, in accordance with aspects hereof.
Figure 2B:
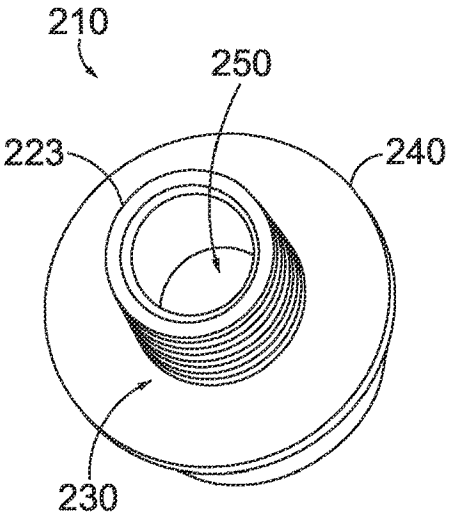
Figure 2A:
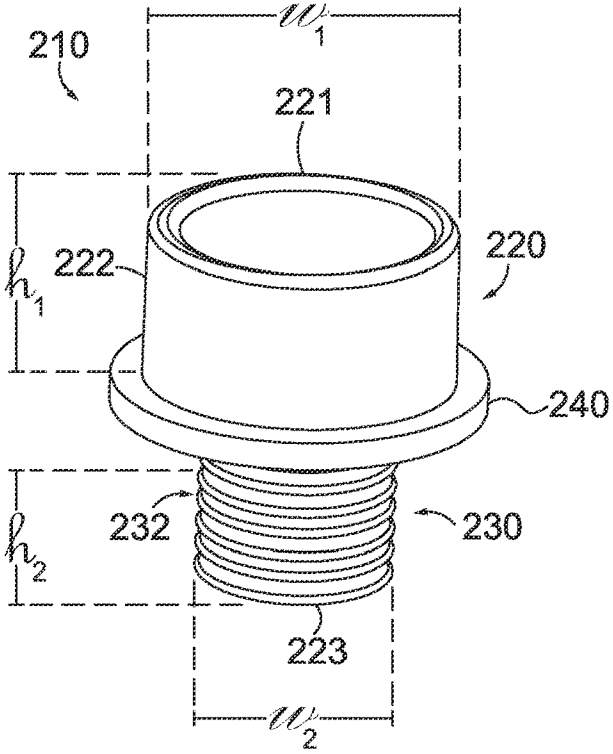

FIGS. 2A-2C depict the baluster connector 210. In aspects, as discussed above, the baluster connector 210 includes a baluster engaging portion 220 and a support engaging portion 230. As best seen in the aspect depicted in FIG. 2A, the baluster connector 210 includes a flange 240 that is positioned between a first end 221 and a second end 223. In aspects, the baluster engaging portion 220 can extend out from the flange 240 to the first end 221. In the same or alternative aspects, the support engaging portion 230 can extend out from the flange 240 to the second end 223. In aspects, the baluster connector 210 can be one integral component, e.g., where the baluster engaging portion 220, the support engaging portion 230, and the flange 240 are integral. In one or more aspects, the baluster connector 210 can be formed using any convenient manufacturing techniques, such as injection molding or extrusion molding.

It should be understood that the specific shape of the baluster connector 210 is just one example shape and that other shapes are contemplated for use in the present disclosure. For instance, in one alternative aspect, the baluster engaging portion 220 can exhibit a cross-sectional shape of a square or rectangle to accommodate an appropriate fit with a similarly shaped baluster. In another alternative aspect, the baluster engaging portion 220 can be shaped as depicted in FIG. 2A and a separate adapter member can be coupled to the baluster engaging portion 220 to accommodate a non-cylindrical shaped baluster, e.g., a baluster having a square or rectangular cross-sectional shape.

In various aspects, the first end 221 can be positioned a distance $h_1$ from the flange 240 by about 2 millimeters (mm) to about 50 mm, by about 3 mm to about 45 mm, or by about 4 mm to about 40 mm. In the same or alternative aspects, the second end 223 can be positioned a distance $h_2$ from the flange 240 by about 2 mm to about 50 mm, by about 3 mm to about 45 mm, or by about 4 mm to about 40 mm. In aspects, the length of the baluster engaging portion 220 can be the distance $h_1$ between the first end 221 and the flange 240. In various aspects, the length of the support engaging portion 230 can be the distance $h_2$ between the second end 223 and the flange 240.

In certain aspects, the baluster engaging portion 220 can include a sidewall 222 that extends out from the flange 240 to the first end 221, as best seen in FIGS. 2A and 2C. In various aspects, the baluster engaging portion 220 has a width $w_1$ that is from about 2.5 mm to about 110 mm, from about 5 mm to about 80 mm, from about 6 mm to about 65 mm, or from about 7 mm to about 50 mm. In the same or alternative aspects, the baluster engaging portion 220 exhibits a substantially similar width $w_1$ from a position adjacent the flange 240 to a position at or near the first end 221. In such an aspect, the sidewall 222 can define a cylinder-shaped structure having a substantially similar diameter from end to end. In an alternative aspect not depicted in the figures, the baluster engaging portion or associated sidewall can have a tapered (or other) shape to allow for ease of engagement, e.g., insertion into a void of a baluster. In the aspect depicted in FIGS. 2A-2C, the baluster engaging portion 220 and the support engaging portion 230 are depicted as having voids in the respective portions. In alternative aspects, the baluster engaging portion 220 and/or the support engaging portion 230 can lack such voids and can include one or more materials forming a solid structure for all or a portion of the width $w_1$ or the width $w_2$, respectively.

In aspects, as discussed above, the baluster engaging portion 220 can be inserted into a void of a baluster, e.g., the baluster 132 of FIG. 1. In aspects, when assembled, the baluster engaging portion 220 may be entirely or partially positioned within the baluster 132. In aspects, such as that depicted in FIG. 1, where the first end 133 of the baluster 132 is inserted into the aperture 111, the first end 133 may shift vertically within the void 113 or aperture 111 of the top rail 110, since the first end 133 may not be fixedly secured to the top rail 110. In such aspects, in order for the baluster 132 to not become disengaged or decoupled from the bottom rail 120 and/or from the baluster connector 210, a distance $h_1$ of the baluster engaging portion 220 of the baluster connector 210 can be greater than or equal to the distance the first end 133 of the baluster 132 can vertically shift within the void 113 or the aperture 111, when in an assembled configuration.

In an alternative aspect not depicted in the figures, a baluster can be received in a void of the baluster engaging portion as opposed to the baluster engaging portion of a baluster connector being inserted into a void of the baluster.

In aspects, the support engaging portion 230 can engage with or couple to the bottom rail 120, or other support, in any convenient manner. In aspects, the support engaging portion 230 can include one or more structural features that can contact at least a portion of a bottom rail, e.g., the bottom rail 120 of FIG. 1, to temporarily or permanently secure the baluster connector 210 to the bottom rail 120 or other support. For instance, as best seen in FIG. 2A, the support engaging portion 230 includes a plurality of ridges 232 that can provide a friction fit and/or compression fit in or to the bottom rail 120 at or near an aperture of the bottom rail, e.g., the aperture 123 of the bottom rail 120. In various aspects, all or a portion of the plurality of ridges 232 can interact with one or more portions of the bottom rail 120 to provide a friction fit and/or compression fit, e.g., the portions of the bottom rail 120 that define an aperture, e.g., the aperture 123, in the bottom rail. In such aspects, all or a portion of the plurality of ridges 232 can contact one or more portions of the bottom rail 120 that define the aperture 123. In certain aspects, the width $w_2$ of the support engaging portion 230 can be equal to or greater than a width and/or diameter of the aperture 123 or void so as to facilitate such a compression and/or friction fit. In various aspects, the support engaging portion 230 can have a width $w_2$ that is from about 2.5 mm to about 110 mm, from about 5 mm to about 80 mm, from about 6 mm to about 65 mm, or from about 7 mm to about 50 mm.

As discussed above, in the aspect depicted in FIG. 2A, the baluster connector 210 can include a plurality of ridges 232 on the support engaging portion 230, which may facilitate temporarily or permanently securing the baluster connector 210 to the bottom rail 120. In the aspect depicted in FIG. 2A, the plurality of ridges 232 are circular ridges or serrations, e.g., the ridges or serrations are parallel or substantially parallel to one another. In aspects, such circular ridges can provide a tight fight with a support or bottom rail and/or lock in place the support engaging portion 230, and/or the baluster connector 210, to the bottom rail or support. In the same or alternative aspects, the circular ridges may function as a seal to restrict the ability of water or other elements to enter into the bottom rail or support. In an alternate aspect not depicted in the figures, the plurality of ridges or serrations may be helical, e.g., spiral, which may aid in inserting the support engaging portion 230 into the support or bottom rail, e.g., by rotating the plug into an aperture of the support or bottom rail.

Figure 2D:
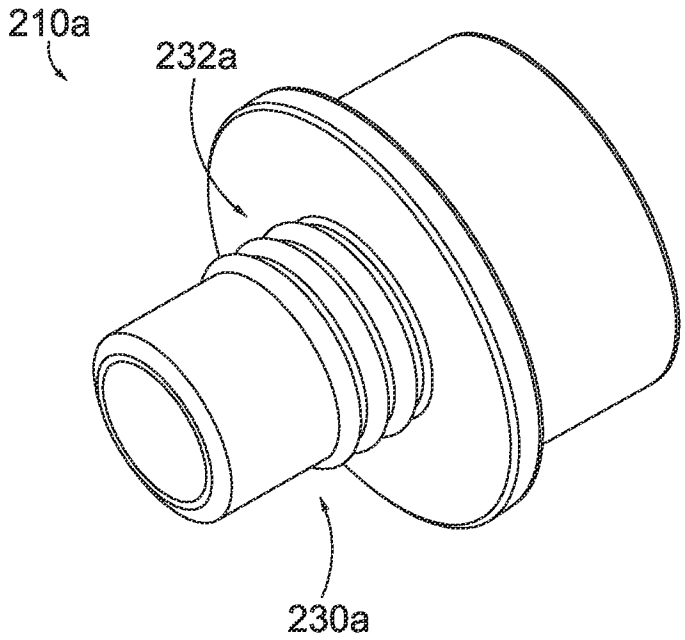
FIG. 2D depicts another example baluster connector, in accordance with aspects hereof.

In certain aspects, the plurality of ridges 232 may be integral to the support engaging portion 230. In alternate aspects, the plurality of ridges 232 may be provided as an over mold, e.g., formed from rubber or other material. In one aspect, the plurality of ridges 232 may be an over mold material that includes two, three, four, five, six, seven, or eight ridges. FIG. 2D depicts an example variation of the support engaging portion 230 of the baluster connector 210, designated as baluster connector 210*a*. In the aspect depicted in FIG. 2D, support engaging portion 230*a* of the baluster connector 210*a* includes a plurality of ridges 232*a* that are present on a portion of the length of the support engaging portion 230*a*. In such aspects, not having ridges along the full length of the support engaging portion 230*a* may result in increased production efficiencies and/or reduce the amount of material necessary to produce the baluster connectors 210*a*.

In aspects, when a baluster connector couples a baluster to the bottom rail, the flange may be positioned so that it is in contact with an outer surface of the bottom rail. For instance, as can be seen in FIG. 1, the flange 240*a* of the baluster connector 210*a* can be in contact with an outer surface 125 of the bottom rail 120 when the baluster connector 210*a* is coupling and/or connecting the baluster 136 to the bottom rail 120. It should be understood that, while the flange 240*a* of the baluster connector 210*a* depicted in FIG. 1, exhibits a flat-disc-shaped appearance, other example flanges are also contemplated for the baluster connectors disclosed herein. For instance, in an aspect not depicted in the figures, the flange, e.g., the flange 240*a*, can exhibit an angled or tapered shape, where a portion of the tapered region can be inserted into the aperture 123 of the bottom rail 120 to facilitate a compression fit and/or to function as a seal to prevent debris or water ingress into the bottom rail 120. It should also be understood that, when assembling any of the railing systems described herein with any of the baluster connectors described herein an O-ring, caulk, adhesive, or over molding applied to a portion of a baluster connector, or a combination thereof, can be utilized to provide better baluster connector retention, water ingress protection, and/or baluster "rattling" prevention.

As best seen in the aspect depicted in FIGS. 2B and 2C, the baluster connector 210 can optionally include a through-hole 250 that extends from the baluster engaging portion 220 to the support engaging portion 230, such that an interior portion of the baluster engaging portion 220 is in fluid communication with an interior portion of the support engaging portion 230. In such an aspect, the through-hole 250 may reduce the mass of the baluster connector and/or allow moisture transmission there through. In an alternate aspect, the baluster connector may not include such a through-hole thereby closing off all or part of an interior portion of the baluster engaging portion 220 to an interior portion of the support engaging portion 230. For instance, in one alternative aspect, the flange 240 may structurally resemble a flat, solid disc shaped component, and/or may not include a void, which in aspects, may limit moisture transport and/or pest or insects from traversing there through.

Figure 3C:
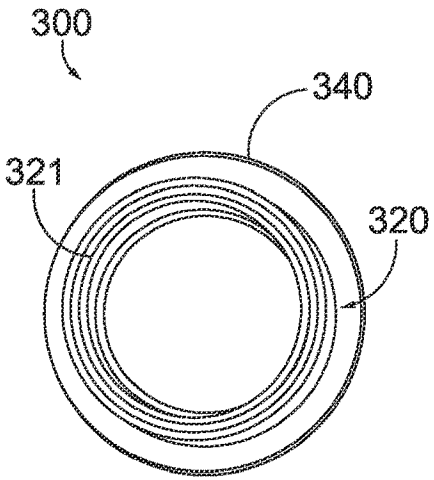
FIGS. 3A-3C depict another example baluster connecter, in accordance with aspects hereof.
Figure 3B:
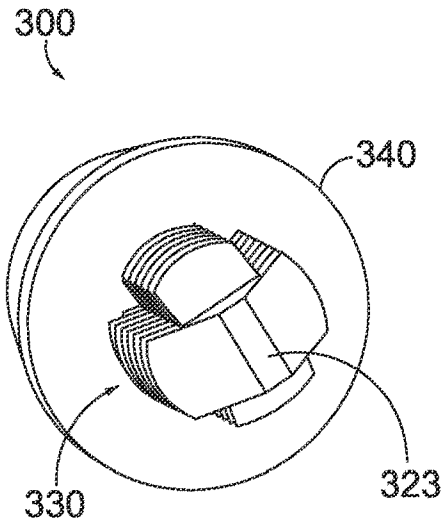
Figure 3A:
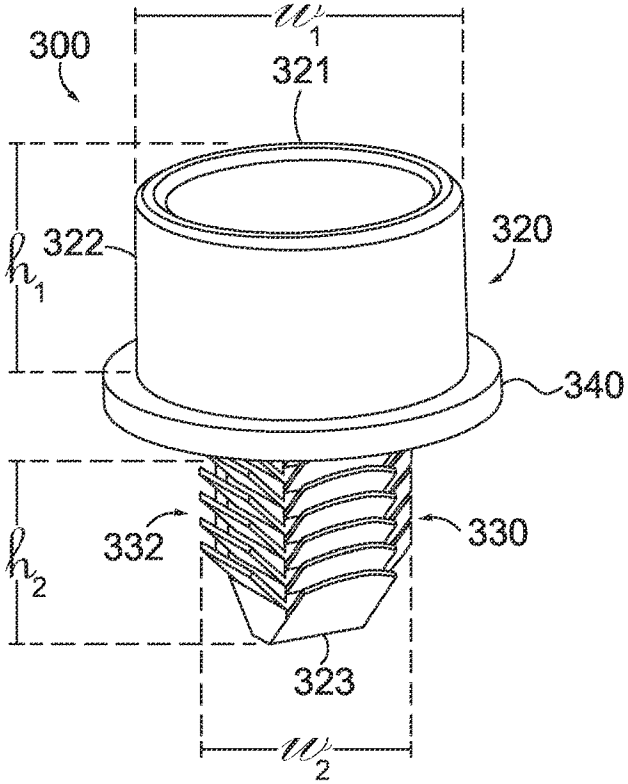

FIGS. 3A-3C depict another baluster connector 300. In aspects, the baluster connector 300 includes a baluster engaging portion 320, a support engaging portion 330, and a flange 340. In aspects, the baluster connector 300 can operate similarly to the baluster connector 210 discussed above with reference to FIGS. 1 and 2A-2C. For instance, in aspects, the baluster engaging portion 320 can be inserted into a void of a baluster, e.g., a void in the second end 135 of the baluster 132 of FIG. 1, while the support engaging portion 330 can be coupled to a bottom rail, e.g., the bottom rail 120 of FIG. 1. In the same or alternative aspects, when in the assembled configuration, the flange 340 of the baluster connector 300 may contact an outer surface of the bottom rail, e.g., the outer surface 125 of the bottom rail 120 of FIG. 1.

As best seen in the aspect depicted in FIG. 3A, the baluster 310 includes a flange 340 that is positioned between a first end 321 and a second end 323. In aspects, the baluster engaging portion 320 can extend out from the flange 340 to the first end 321. In the same or alternative aspects, the support engaging portion 330 can extend out from the flange 340 to the second end 323.

In various aspects, any or all of the dimensional properties of the baluster connector 210 of FIGS. 2A-2C discussed above can apply to the baluster connector 300. For instance, the length of the baluster engaging portion 320 and/or the distance $h_1$ from the first end 321 to the flange 340, can include any or all of the values and ranges discussed above with reference to the respective portions of the baluster connector 210. In the same or alternative aspects, the length of the support engaging portion 330 and/or the distance $h_2$ from the second end 323 to the flange 340, can include any or all of the values and ranges discussed above with reference to the respective portions of the baluster connector 210.

In certain aspects, the baluster engaging portion 320 can include a sidewall 322 that extends from the flange 340 to the first end 321, as best seen in FIG. 3A. In various aspects, the baluster engaging portion 320 has a width $w_1$ that can include any or all of the values and ranges of the width $w_1$ of the baluster engaging portion 220 of the baluster connector 210 discussed above.

In aspects, the support engaging portion 330 can include one or more structural features that can contact at least a portion of a bottom rail, e.g., the bottom rail 120 of FIG. 1 to temporarily or permanently secure the baluster connector 300 to a bottom rail. For instance, in the aspect seen in FIG. 3A, the support engaging portion 330 includes a plurality of angled ridges 332 that can provide a friction fit and/or compression fit in a bottom rail, e.g., the bottom rail 120 at or near the aperture 123 of FIG. 1. In such aspects, the width $w_2$ of the support engaging portion 330 can be equal to or greater than a width of the aperture 123 or void so as to facilitate such a compression and/or friction fit. In various aspects, the support engaging portion 330 can have a width $w_2$ that includes any of the values and/or ranges of the support engaging portion 230 of the baluster connector 210 of FIG. 2A discussed above.

Figure 4C:
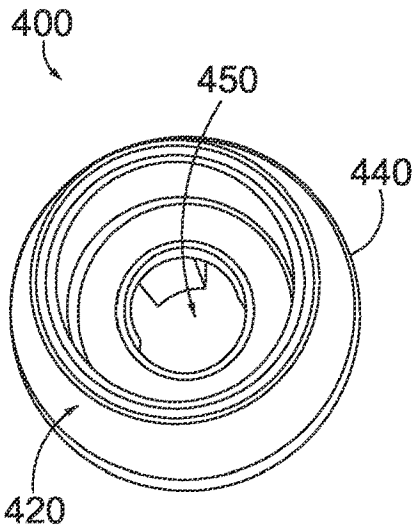
FIGS. 4A-4C depict yet another example baluster connecter, in accordance with aspects hereof.
Figure 4B:
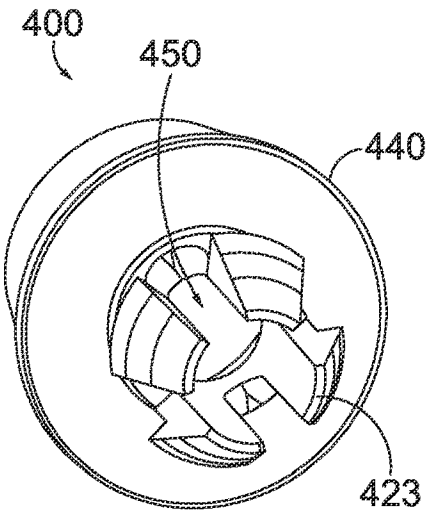
Figure 4A:
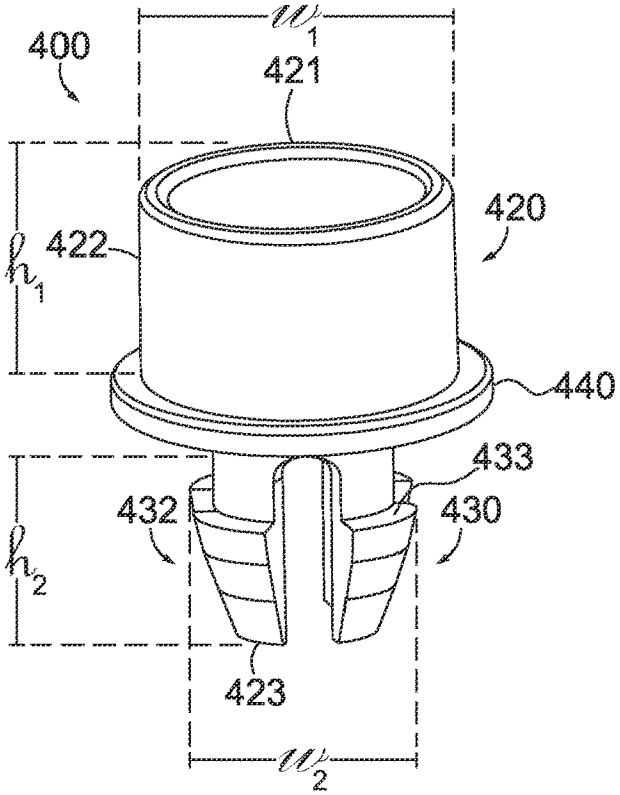

FIGS. 4A-4C depict another baluster connector 400. In aspects, the baluster connector 400 includes a baluster engaging portion 420, a support engaging portion 430, and a flange 440. In aspects, the baluster connector 400 can operate similarly to the baluster connector 210 discussed above with reference to FIGS. 1 and 2A-2C. For instance, in aspects, the baluster engaging portion 420 can be inserted into a void of a baluster, e.g., the void in the second end 135 of the baluster 132 of FIG. 1, while the support engaging portion 430 can be coupled to a bottom rail, e.g., the bottom rail 120 of FIG. 1. In the same or alternative aspects, when in the assembled configuration, the flange 440 of the baluster connector 400 may contact an outer surface of the bottom rail, e.g., the outer surface 125 of the bottom rail 120 of FIG. 1.

As best seen in the aspect depicted in FIG. 4A, the baluster 410 includes a flange 440 that is positioned between a first end 421 and a second end 423. In aspects, the baluster engaging portion 420 can extend out from the flange 440 to the first end 421. In the same or alternative aspects, the support engaging portion 430 can extend out from the flange 440 to the second end 423.

In various aspects, one or more of the dimensional properties of the baluster connector 210 of FIGS. 2A-2C discussed above can apply to the baluster connector 400. For instance, the length of the baluster engaging portion 420 and/or the distance $h_1$ from the first end 421 to the flange 440, can include any or all of the values and ranges discussed above with reference to the respective portions of the baluster connector 210. In the same or alternative aspects, the length of the support engaging portion 430 and/or the distance $h_2$ from the second end 423 to the flange 440, can include any or all of the values and ranges discussed above with reference to the respective portions of the baluster connector 210.

In certain aspects, the baluster engaging portion 420 can include a sidewall 422 that extends from the flange 440 to the first end 421, as best seen in FIG. 4A. In various aspects, the baluster engaging portion 420 has a width $w_1$ that can include any or all of the values and ranges of the width $w_1$ of the baluster engaging portion 220 of the baluster connector 210 discussed above. In various aspects, the support engaging portion 430 can have a width $w_2$ that includes any of the values and/or ranges of the support engaging portion 230 of the baluster connector 210 of FIG. 2A discussed above.

Figure 4D:
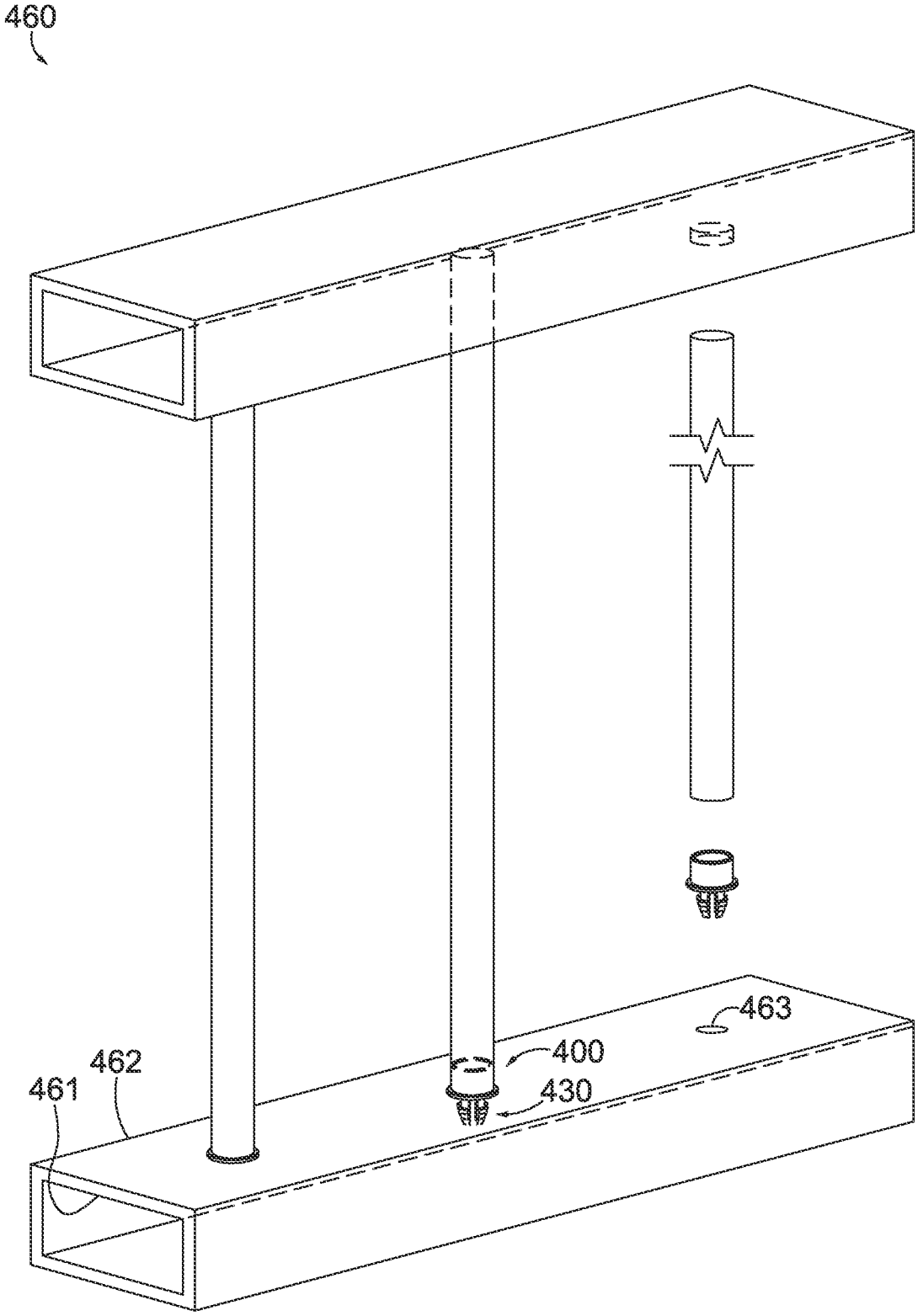
FIG. 4D depicts another example railing system, in accordance with aspects hereof.

In aspects, the support engaging portion 430 can include one or more structural features that can contact at least a portion of a bottom rail, e.g., the bottom rail 120 of FIG. 1 to temporarily or permanently secure the baluster connector 400 to a bottom rail. For instance, as best seen in FIG. 4A, the support engaging portion 430 includes a plurality of spaced apart locking members 432 that can interact with a portion of a bottom rail, a complementary locking member associated with a bottom rail, or both. For instance, in an aspect of a railing system 460 depicted in FIG. 4D, the support engaging portion 430 can be inserted into an aperture of a bottom rail, e.g., the aperture 463 of the bottom rail 462, and a portion of one or more of the plurality of spaced apart locking members 432, e.g., the portion 433 depicted in FIG. 4A, can interact with an inner surface 461 of the bottom rail 462 (and/or a complementary locking member associated with the bottom rail 462 not depicted in FIG. 4D) in order to secure the baluster connector 400 in place and to the bottom rail 462. In aspects, for example, the portion 433 of one of the plurality of spaced apart locking members 432 may interact with the bottom rail 462, e.g., via the inner surface 461, in such a manner so as to physically prevent disengagement or decoupling of the baluster connector 400 (or baluster coupled thereto) from the bottom rail 462 when an upward force is applied to the baluster connector 400 or baluster coupled thereto.

As best seen in the aspect depicted in FIGS. 4B and 4C, the baluster connector 400 can optionally include a through-hole 450 that extends from the baluster engaging portion 420 to the support engaging portion 430, such that an interior portion of the baluster engaging portion 420 is in fluid communication with an interior portion of the support engaging portion 430. In an alternate aspect, the baluster connector may not include such a through-hole thereby closing off all or part of an interior portion of the baluster engaging portion 420 to an interior portion of the support engaging portion 430. For instance, in one alternative aspect, the flange 440 may structurally resemble a flat, solid disc shaped component, and/or may not include a void.

Figure 5C:
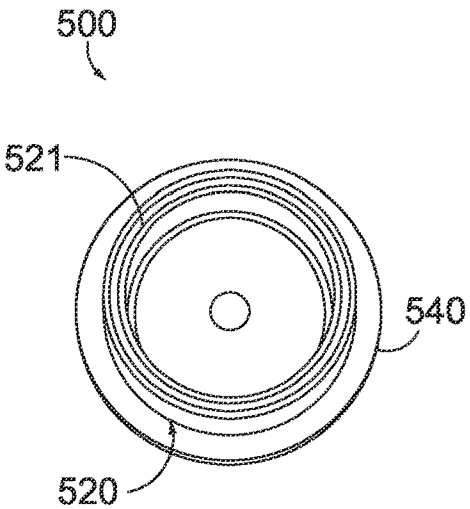
FIGS. 5A-5C depict another example baluster connecter, in accordance with aspects hereof.
Figure 5B:
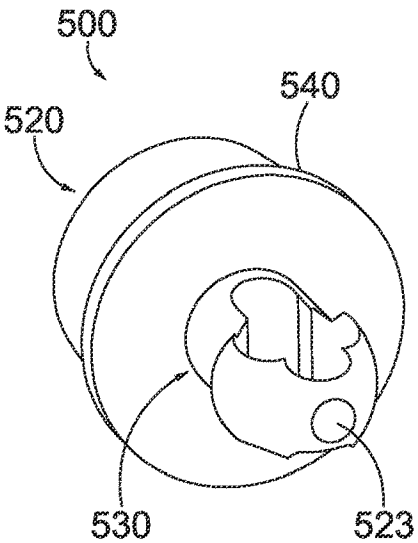
Figure 5A:
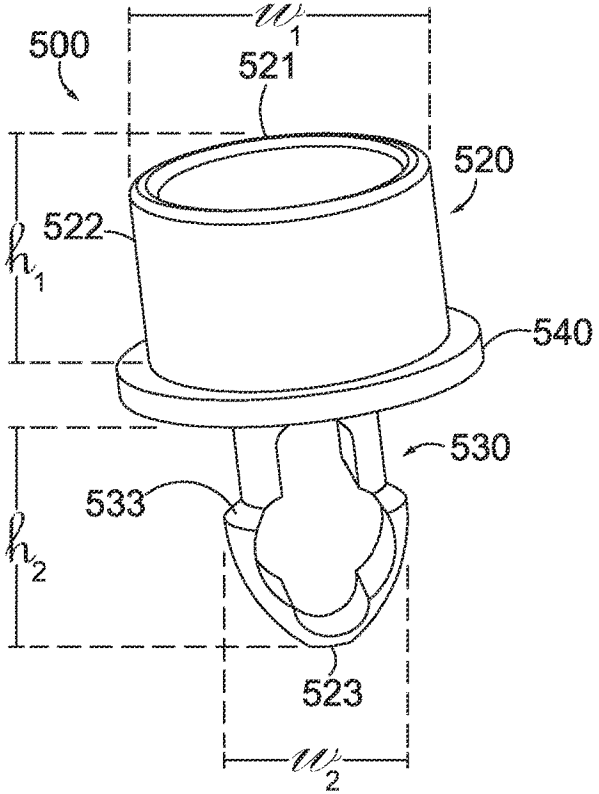

FIGS. 5A-5C depict another baluster connector 500. In aspects, the baluster connector 500 includes a baluster engaging portion 520, a support engaging portion 530, and a flange 540. In aspects, the baluster connector 500 can operate similarly to the baluster connector 210 discussed above with reference to FIGS. 1 and 2A-2C. For instance, in aspects, the baluster engaging portion 520 can be inserted into a void of a baluster, e.g., the void at or near a second end 135 of the baluster 132 of FIG. 1, while the support engaging portion 530 can be coupled to a bottom rail, e.g., the bottom rail 120 of FIG. 1. In the same or alternative aspects, when in the assembled configuration, the flange 540 of the baluster connector 500 may contact an outer surface of the bottom rail, e.g., the outer surface 125 of the bottom rail 120 of FIG. 1.

As best seen in the aspect depicted in FIG. 5A, the baluster 510 includes a flange 540 that is positioned between a first end 521 and a second end 523. In aspects, the baluster engaging portion 520 can extend out from the flange 540 to the first end 521. In the same or alternative aspects, the support engaging portion 530 can extend out from the flange 540 to the second end 523.

In various aspects, one or more of the dimensional properties of the baluster connector 210 of FIGS. 2A-2C discussed above can apply to the baluster connector 500. For instance, the height of the baluster engaging portion 520 and/or the distance $h_1$ from the first end 521 to the flange 540, can include any or all of the values and ranges discussed above with reference to the respective portions of the baluster connector 210. In the same or alternative aspects, the height of the support engaging portion 530 and/or the distance $h_2$ from the second end 523 to the flange 540, can include any or all of the values and ranges discussed above with reference to the respective portions of the baluster connector 210.

In certain aspects, the baluster engaging portion 520 can include a sidewall 522 that extends from the flange 540 to the first end 521, as best seen in FIG. 5A. In various aspects, the baluster engaging portion 520 has a width $w_1$ that can include any or all of the values and ranges of the width $w_1$ of the baluster engaging portion 220 of the baluster connector 210 discussed above. In various aspects, the support engaging portion 530 can have a width $w_2$ that includes any of the values and/or ranges of the support engaging portion 230 of the baluster connector 210 of FIG. 2A discussed above.

In aspects, the support engaging portion 530 can include one or more structural features that can contact at least a portion of a bottom rail, e.g., the bottom rail 120 of FIG. 1 to temporarily or permanently secure the baluster connector 500 to a bottom rail. For instance, as best seen in the aspect depicted in FIG. 5A, the support engaging portion 530 exhibits a variable width shape having a maximum width portion 533 positioned about midway along the length of the support engaging portion 530. In such aspects, this maximum width portion 533 can interact with a portion of a bottom rail, a complementary locking member associated with a bottom rail, or both, in a manner similar to that described above in FIG. 4D with respect to the baluster connector 400. In aspects, for example, the maximum width portion 533 may interact with the bottom rail 462, e.g., via the inner surface 461, in such a manner so as to physically prevent disengagement or decoupling of the baluster connector 500 (or baluster coupled thereto) from the bottom rail 462 when an upward force is applied to the baluster connector 500 or baluster coupled thereto.

Figure 6C:
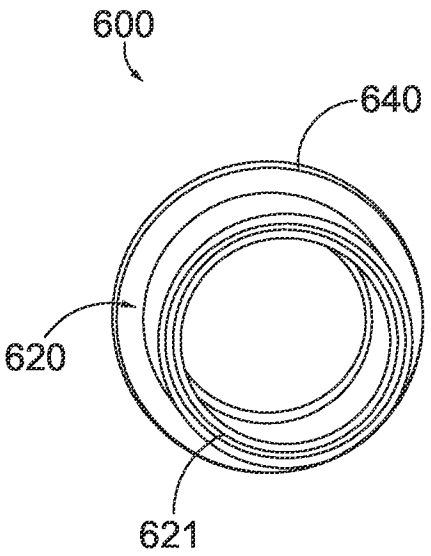
FIGS. 6A-6C depict yet another example baluster connecter, in accordance with aspects hereof.
Figure 6B:
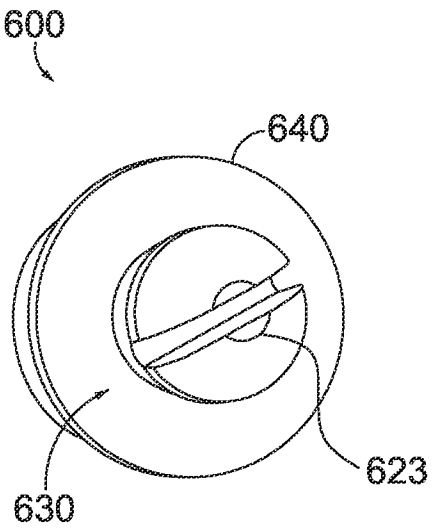
Figure 6A:
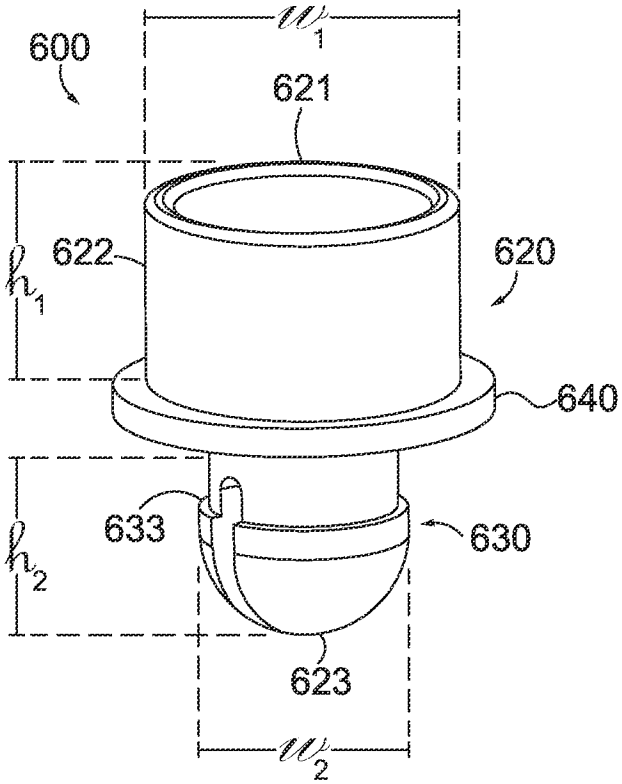

FIGS. 6A-6C depict another baluster connector 600. In aspects, the baluster connector 600 includes a baluster engaging portion 620, a support engaging portion 630, and a flange 640. In aspects, the baluster connector 600 can operate similarly to the baluster connector 210 discussed above with reference to FIGS. 1 and 2A-2C. For instance, in aspects, the baluster engaging portion 620 can be inserted into a void of a baluster, e.g., the void at or near the second end 135 of the baluster 132 of FIG. 1, while the support engaging portion 630 can be coupled to a bottom rail, e.g., the bottom rail 120 of FIG. 1. In the same or alternative aspects, when in the assembled configuration, the flange 640 of the baluster connector 600 may contact an outer surface of the bottom rail, e.g., the outer surface 125 of the bottom rail 120 of FIG. 1.

As best seen in the aspect depicted in FIG. 6A, the baluster 610 includes a flange 640 that is positioned between a first end 621 and a second end 623. In aspects, the baluster engaging portion 620 can extend out from the flange 640 to the first end 621. In the same or alternative aspects, the support engaging portion 630 can extend out from the flange 640 to the second end 623.

In various aspects, one or more of the dimensional properties of the baluster connector 210 of FIGS. 2A-2C discussed above can apply to the baluster connector 600. For instance, the height of the baluster engaging portion 620 and/or the distance $h_1$ from the first end 621 to the flange 640, can include any or all of the values and ranges discussed above with reference to the respective portions of the baluster connector 210. In the same or alternative aspects, the height of the support engaging portion 630 and/or the distance $h_2$ from the second end 623 to the flange 640, can include any or all of the values and ranges discussed above with reference to the respective portions of the baluster connector 210.

In certain aspects, the baluster engaging portion 620 can include a sidewall 622 that extends from the flange 640 to the first end 621, as best seen in FIG. 6A. In various aspects, the baluster engaging portion 620 has a width $w_1$ that can include any or all of the values and ranges of the width $w_1$ of the baluster engaging portion 220 of the baluster connector 210 discussed above. In various aspects, the support engaging portion 630 can have a width $w_2$ that includes any of the values and/or ranges of the support engaging portion 230 of the baluster connector 210 of FIG. 2A discussed above.

In aspects, the support engaging portion 630 can include one or more structural features that can contact at least a portion of a bottom rail, e.g., the bottom rail 120 of FIG. 1 to temporarily or permanently secure the baluster connector 600 to a bottom rail. For instance, as best seen in the aspect depicted in FIG. 6A, the support engaging portion 630 exhibits a variable width shape having a maximum width portion 633 positioned about midway along the length of the support engaging portion 630. In aspects, this maximum width portion 633 can interact with a portion of a bottom rail, a complementary locking member associated with a bottom rail, or both, in a manner similar to that described above in FIG. 4D with respect to the baluster connector 400. In aspects, for example, the maximum width portion 633 may interact with the bottom rail 462, e.g., via the inner surface 461, in such a manner so as to physically prevent disengagement or decoupling of the baluster connector 600 (or baluster coupled thereto) from the bottom rail 462 when an upward force is applied to the baluster connector 600 or baluster coupled thereto.

Figure 7C:
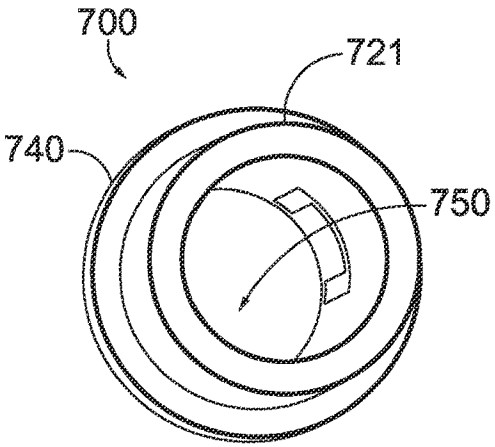
FIGS. 7A-7C depict another example baluster connecter, in accordance with aspects hereof.
Figure 7B:
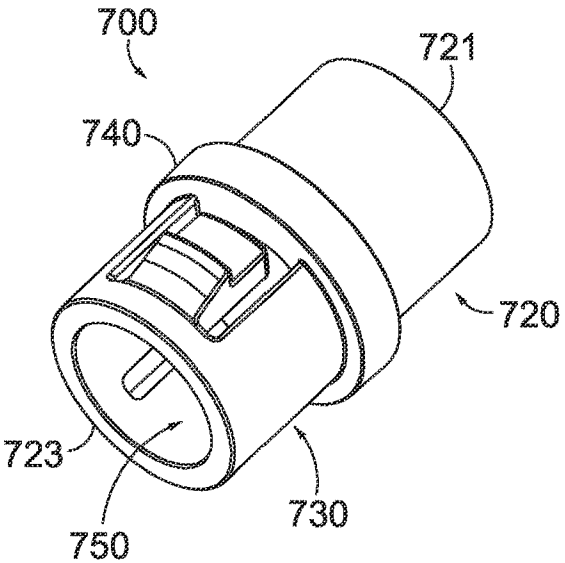
Figure 7A:
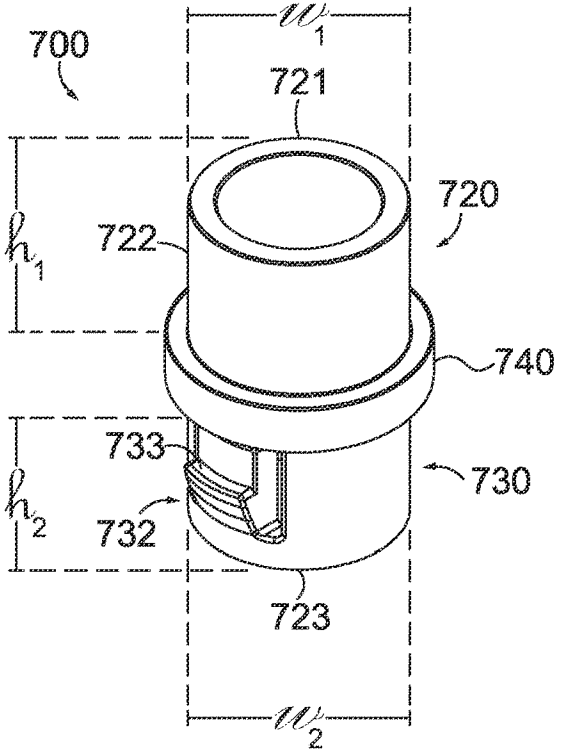

FIGS. 7A-7C depict another baluster connector 700. In aspects, the baluster connector 700 includes a baluster engaging portion 720, a support engaging portion 730, and a flange 740. In aspects, the baluster connector 700 can operate similarly to the baluster connector 210 discussed above with reference to FIGS. 1 and 2A-2C. For instance, in aspects, the baluster engaging portion 720 can be inserted into a void of a baluster, e.g., the void at or near a second end 135 of the baluster 132 of FIG. 1, while the support engaging portion 730 can be coupled to a bottom rail, e.g., the bottom rail 120 of FIG. 1. In the same or alternative aspects, when in the assembled configuration, the flange 740 of the baluster connector 700 may contact an outer surface of the bottom rail, e.g., the outer surface 125 of the bottom rail 120 of FIG. 1.

As best seen in the aspect depicted in FIG. 7A, the baluster 710 includes a flange 740 that is positioned between a first end 721 and a second end 723. In aspects, the baluster engaging portion 720 can extend out from the flange 740 to the first end 721. In the same or alternative aspects, the support engaging portion 730 can extend out from the flange 740 to the second end 723.

In various aspects, one or more of the dimensional properties of the baluster connector 210 of FIGS. 2A-2C discussed above can apply to the baluster connector 700. For instance, the height of the baluster engaging portion 720 and/or the distance $h_1$ from the first end 721 to the flange 740, can include any or all of the values and ranges discussed above with reference to the respective portions of the baluster connector 210. In the same or alternative aspects, the height of the support engaging portion 730 and/or the distance $h_2$ from the second end 723 to the flange 740, can include any or all of the values and ranges discussed above with reference to the respective portions of the baluster connector 210.

In certain aspects, the baluster engaging portion 720 can include a sidewall 722 that extends from the flange 740 to the first end 721, as best seen in FIG. 7A. In various aspects, the baluster engaging portion 720 has a width $w_1$ that can include any or all of the values and ranges of the width $w_1$ of the baluster engaging portion 220 of the baluster connector 210 discussed above. In various aspects, the support engaging portion 730 can have a width $w_2$ that includes any of the values and/or ranges of the support engaging portion 230 of the baluster connector 210 of FIG. 2A discussed above.

In aspects, the support engaging portion 730 can include one or more structural features that can contact at least a portion of a bottom rail, e.g., the bottom rail 120 of FIG. 1, to temporarily or permanently secure the baluster connector 700 to a bottom rail. For instance, as best seen in the aspect depicted in FIG. 7A, the support engaging portion 730 includes one or more tabs, e.g., tab 732, that may move inward when inserting into an aperture in a bottom rail or support, and once inserted into an aperture, the tab 732 may return to its resting position and an engaging surface 733 of the tab 732 may aid in securing the support engaging portion 730 to the support or bottom rail, in aspects. For example, in such aspects, this engaging surface 733 can interact with a portion of a bottom rail, a complementary locking member associated with a bottom rail, or both, in a manner similar to that described above in FIG. 4D with respect to the baluster connector 400. In aspects, for example, the engaging surface 733 may interact with the bottom rail 462, e.g., via the inner surface 461, in such a manner so as to physically prevent disengagement or decoupling of the baluster connector 700 (or baluster coupled thereto) from the bottom rail 462 when an upward force is applied to the baluster connector 700 or baluster coupled thereto. In one aspect, the baluster connector 700 can include two tabs positioned on opposing sides of the support engaging portion 730, or in any other arrangement or position.

As best seen in the aspect depicted in FIGS. 7B and 7C, the baluster connector 700 can optionally include a through-hole 750 that extends from the baluster engaging portion 720 to the support engaging portion 730, such that an interior portion of the baluster engaging portion 720 is in fluid communication with an interior portion of the support engaging portion 730. In an alternate aspect, the baluster connector may not include such a through-hole thereby closing off all or part of an interior portion of the baluster engaging portion 720 to an interior portion of the support engaging portion 730. For instance, in one alternative aspect, the flange 740 may structurally resemble a flat, solid disc shaped component, and/or may not include a void.

Figure 8C:
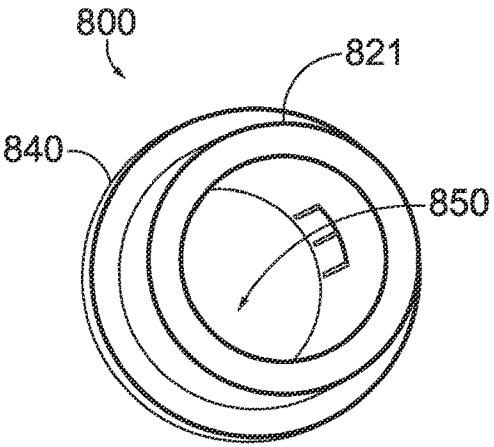
FIGS. 8A-8C depict yet another example baluster connecter, in accordance with aspects hereof.
Figure 8B:
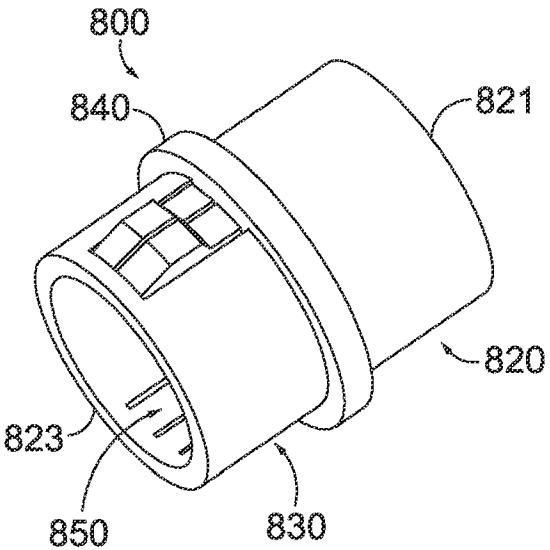
Figure 8A:
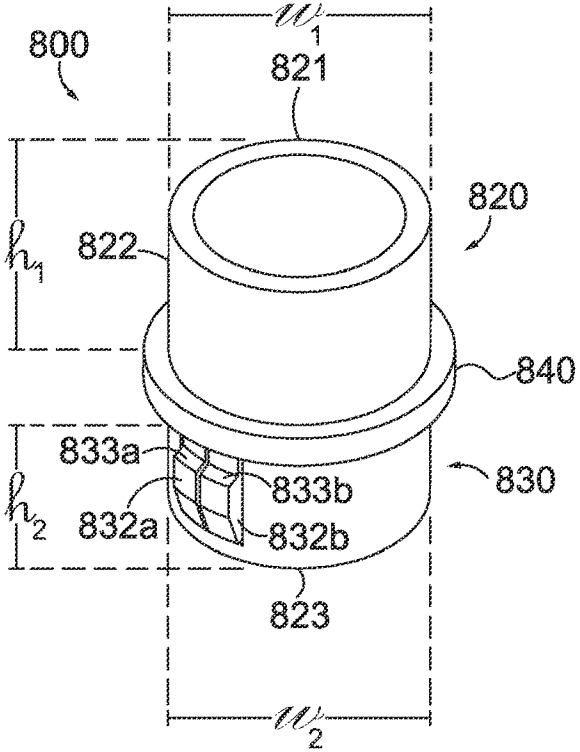

FIGS. 8A-8C depict another baluster connector 800. In aspects, the baluster connector 800 includes a baluster engaging portion 820, a support engaging portion 830, and a flange 840. In aspects, the baluster connector 800 can operate similarly to the baluster connector 210 discussed above with reference to FIGS. 1 and 2A-2C. For instance, in aspects, the baluster engaging portion 820 can be inserted into a void of a baluster, e.g., the void at or near a second end 135 of the baluster 132 of FIG. 1, while the support engaging portion 830 can be coupled to a bottom rail, e.g., the bottom rail 120 of FIG. 1. In the same or alternative aspects, when in the assembled configuration, the flange 840 of the baluster connector 800 may contact an outer surface of the bottom rail, e.g., the outer surface 125 of the bottom rail 120 of FIG. 1.

As best seen in the aspect depicted in FIG. 8A, the baluster 810 includes a flange 840 that is positioned between a first end 821 and a second end 823. In aspects, the baluster engaging portion 820 can extend out from the flange 840 to the first end 821. In the same or alternative aspects, the support engaging portion 830 can extend out from the flange 840 to the second end 823.

In various aspects, one or more of the dimensional properties of the baluster connector 210 of FIGS. 2A-2C discussed above can apply to the baluster connector 800. For instance, the height of the baluster engaging portion 820 and/or the distance $h_1$ from the first end 821 to the flange 840, can include any or all of the values and ranges discussed above with reference to the respective portions of the baluster connector 210. In the same or alternative aspects, the height of the support engaging portion 830 and/or the distance $h_2$ from the second end 823 to the flange 840, can include any or all of the values and ranges discussed above with reference to the respective portions of the baluster connector 210.

In certain aspects, the baluster engaging portion 820 can include a sidewall 822 that extends from the flange 840 to the first end 821, as best seen in FIG. 8A. In various aspects, the baluster engaging portion 820 has a width $w_1$ that can include any or all of the values and ranges of the width $w_1$ of the baluster engaging portion 220 of the baluster connector 210 discussed above. In various aspects, the support engaging portion 830 can have a width $w_2$ that includes any of the values and/or ranges of the support engaging portion 230 of the baluster connector 210 of FIG. 2A discussed above.

In aspects, the support engaging portion 830 can include one or more structural features that can contact at least a portion of a bottom rail, e.g., the bottom rail 120 of FIG. 1, to temporarily or permanently secure the baluster connector 800 to a bottom rail. For instance, as best seen in the aspect depicted in FIG. 8A, the support engaging portion 830 includes one or more tabs, e.g., tabs 832*a* and 832*b*, that may move inward when inserting into an aperture in a bottom rail or support, and once inserted into an aperture, the tabs 832*a* and 832*b* may return to their resting position and respective engaging surfaces 833*a* and 833*b* may aid in securing the support engaging portion 830 to the support or bottom rail, in aspects. For example, in such aspects, the engaging surfaces 833*a* and 833*b* can interact with a portion of a bottom rail, a complementary locking member associated with a bottom rail, or both, in a manner similar to that described above in FIG. 4D with respect to the baluster connector 400. In aspects, for example, the engaging surfaces 833*a* and 833*b* may interact with the bottom rail 462, e.g., via the inner surface 461, in such a manner so as to physically prevent disengagement or decoupling of the baluster connector 800 (or baluster coupled thereto) from the bottom rail 462 when an upward force is applied to the baluster connector 800 or baluster coupled thereto. In one aspect, the baluster connector 800 can include one or more tabs positioned on opposing sides of the support engaging portion 830, or in any other arrangement or position.

As best seen in the aspect depicted in FIGS. 8B and 8C, the baluster connector 800 can optionally include a through-hole 850 that extends from the baluster engaging portion 820 to the support engaging portion 830, such that an interior portion of the baluster engaging portion 820 is in fluid communication with an interior portion of the support engaging portion 830. In an alternate aspect, the baluster connector may not include such a through-hole thereby closing off all or part of an interior portion of the baluster engaging portion 820 to an interior portion of the support engaging portion 830. For instance, in one alternative aspect, the flange 840 may structurally resemble a flat, solid disc shaped component, and/or may not include a void.

Figure 9C:
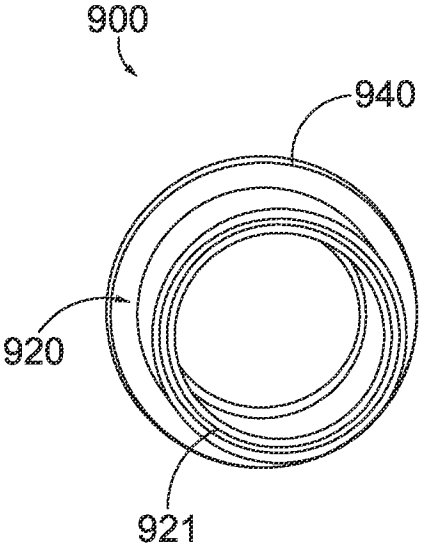
FIGS. 9A-9C depict another example baluster connecter, in accordance with aspects hereof.
Figure 9B:
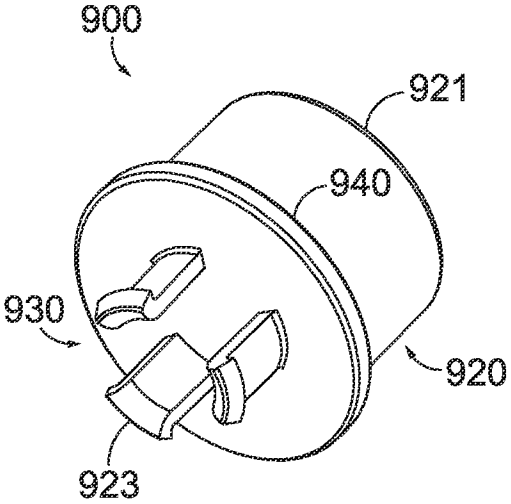
Figure 9A:
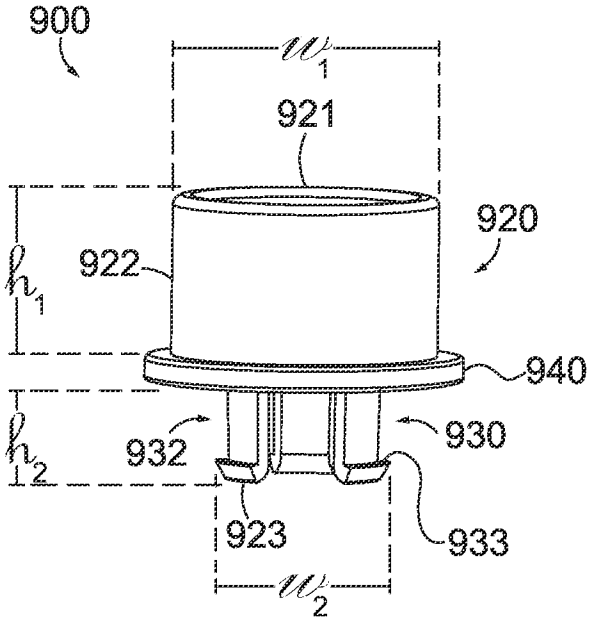

FIGS. 9A-9C depict another baluster connector 900. In aspects, the baluster connector 900 includes a baluster engaging portion 920, a support engaging portion 930, and a flange 940. In aspects, the baluster connector 900 can operate similarly to the baluster connector 210 discussed above with reference to FIGS. 1 and 2A-2C. For instance, in aspects, the baluster engaging portion 920 can be inserted into a void of a baluster, e.g., the void in the second end 135 of the baluster 132 of FIG. 1, while the support engaging portion 930 can be coupled to a bottom rail, e.g., the bottom rail 120 of FIG. 1. In the same or alternative aspects, when in the assembled configuration, the flange 940 of the baluster connector 900 may contact an outer surface of the bottom rail, e.g., the outer surface 125 of the bottom rail 120 of FIG. 1.

As best seen in the aspect depicted in FIG. 9A, the baluster 910 includes a flange 940 that is positioned between a first end 921 and a second end 923. In aspects, the baluster engaging portion 920 can extend out from the flange 940 to the first end 921. In the same or alternative aspects, the support engaging portion 930 can extend out from the flange 940 to the second end 923.

In various aspects, one or more of the dimensional properties of the baluster connector 210 of FIGS. 2A-2C discussed above can apply to the baluster connector 900. For instance, the length of the baluster engaging portion 920 and/or the distance $h_1$ from the first end 921 to the flange 940, can include any or all of the values and ranges discussed above with reference to the respective portions of the baluster connector 210. In the same or alternative aspects, the length of the support engaging portion 930 and/or the distance $h_2$ from the second end 923 to the flange 940, can include any or all of the values and ranges discussed above with reference to the respective portions of the baluster connector 210.

In certain aspects, the baluster engaging portion 920 can include a sidewall 922 that extends from the flange 940 to the first end 921, as best seen in FIG. 9A. In various aspects, the baluster engaging portion 920 has a width $w_1$ that can include any or all of the values and ranges of the width $w_1$ of the baluster engaging portion 220 of the baluster connector 210 discussed above. In various aspects, the support engaging portion 930 can have a width $w_2$ that includes any of the values and/or ranges of the support engaging portion 230 of the baluster connector 210 of FIG. 2A discussed above.

In aspects, the support engaging portion 930 can include one or more structural features that can contact at least a portion of a bottom rail, e.g., the bottom rail 120 of FIG. 1, to temporarily or permanently secure the baluster connector 900 to a bottom rail. For instance, as best seen in FIG. 9A, the support engaging portion 930 includes a plurality of spaced apart locking members 932 that can interact with a portion of a bottom rail, a complementary locking member associated with a bottom rail, or both. For instance, in an aspect of a railing system 460 depicted in FIG. 4D, the support engaging portion 930 can be inserted into an aperture of a bottom rail, e.g., the aperture 463 of the bottom rail 462, and a portion of one or more of the plurality of spaced apart locking members 932, e.g., the portion 933 depicted in FIG. 9A, can interact with an inner surface 461 of the bottom rail 462 (and/or a complementary locking member associated with the bottom rail 462 not depicted in FIG. 4D) in order to secure the baluster connector 900 in place and to the bottom rail 462. In aspects, for example, the portion 933 of one of the plurality of spaced apart locking members 932 may interact with the bottom rail 462, e.g., via the inner surface 461, in such a manner so as to physically prevent disengagement or decoupling of the baluster connector 900 (or baluster coupled thereto) from the bottom rail 462 when an upward force is applied to the baluster connector 900 or baluster coupled thereto.

Figure 10C:
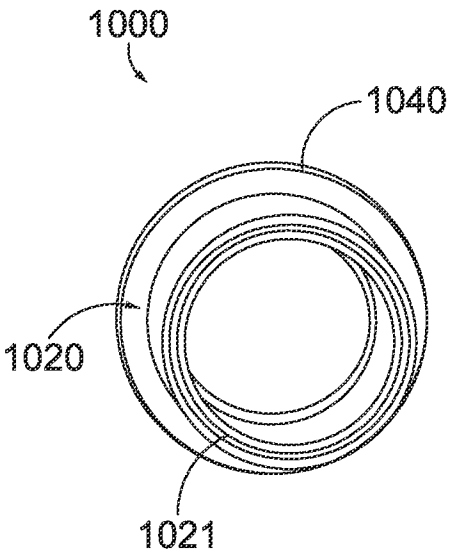
FIGS. 10A-10C depict yet another example baluster connecter, in accordance with aspects hereof.
Figure 10B:
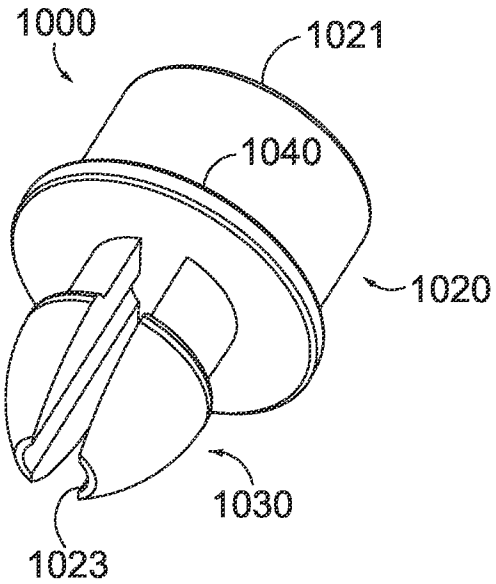
Figure 10A:
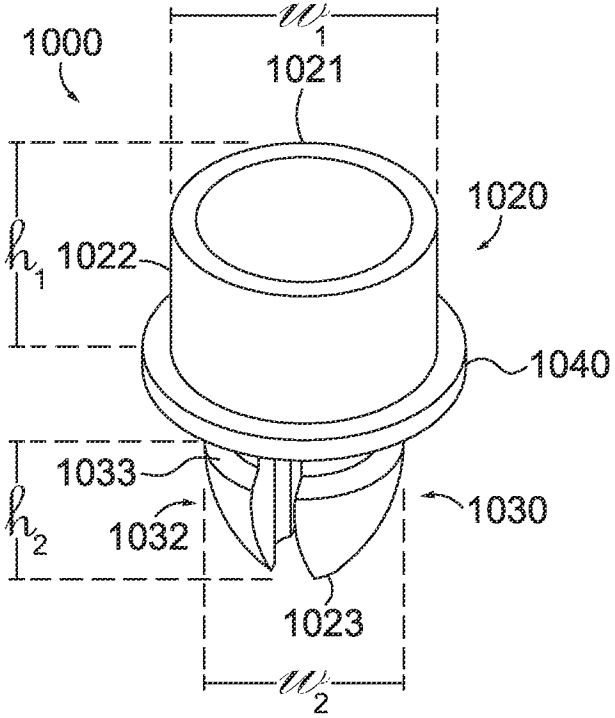

FIGS. 10A-10C depict another baluster connector 1000. In aspects, the baluster connector 1000 includes a baluster engaging portion 1020, a support engaging portion 1030, and a flange 1040. In aspects, the baluster connector 1000 can operate similarly to the baluster connector 210 discussed above with reference to FIGS. 1 and 2A-2C. For instance, in aspects, the baluster engaging portion 1020 can be inserted into a void of a baluster, e.g., the void at or near the second end 135 of the baluster 132 of FIG. 1, while the support engaging portion 1030 can be coupled to a bottom rail, e.g., the bottom rail 120 of FIG. 1. In the same or alternative aspects, when in the assembled configuration, the flange 1040 of the baluster connector 1000 may contact an outer surface of the bottom rail, e.g., the outer surface 125 of the bottom rail 120 of FIG. 1.

As best seen in the aspect depicted in FIG. 10A, the baluster 1010 includes a flange 1040 that is positioned between a first end 1021 and a second end 1023. In aspects, the baluster engaging portion 1020 can extend out from the flange 1040 to the first end 1021. In the same or alternative aspects, the support engaging portion 1030 can extend out from the flange 1040 to the second end 1023.

In various aspects, one or more of the dimensional properties of the baluster connector 210 of FIGS. 2A-2C discussed above can apply to the baluster connector 1000. For instance, the height of the baluster engaging portion 1020 and/or the distance $h_1$ from the first end 1021 to the flange 1040, can include any or all of the values and ranges discussed above with reference to the respective portions of the baluster connector 210. In the same or alternative aspects, the height of the support engaging portion 1030 and/or the distance $h_2$ from the second end 1023 to the flange 1040, can include any or all of the values and ranges discussed above with reference to the respective portions of the baluster connector 210.

In certain aspects, the baluster engaging portion 1020 can include a sidewall 1022 that extends from the flange 1040 to the first end 1021, as best seen in FIG. 10A. In various aspects, the baluster engaging portion 1020 has a width $w_1$ that can include any or all of the values and ranges of the width $w_1$ of the baluster engaging portion 220 of the baluster connector 210 discussed above. In various aspects, the support engaging portion 1030 can have a width $w_2$ that includes any of the values and/or ranges of the support engaging portion 230 of the baluster connector 210 of FIG. 2A discussed above.

In aspects, the support engaging portion 1030 can include one or more structural features that can contact at least a portion of a bottom rail, e.g., the bottom rail 120 of FIG. 1, to temporarily or permanently secure the baluster connector 1000 to a bottom rail. For instance, as best seen in the aspect depicted in FIG. 10A, the support engaging portion 1030 exhibits a variable width shape having a maximum width portion 1033 positioned about midway along the length of the support engaging portion 1030. In aspects, this maximum width portion 1033 can interact with a portion of a bottom rail, a complementary locking member associated with a bottom rail, or both, in a manner similar to that described above in FIG. 4D with respect to the baluster connector 400. In aspects, for example, the maximum width portion 1033 may interact with the bottom rail 462, e.g., via the inner surface 461, in such a manner so as to physically prevent disengagement or decoupling of the baluster connector 1000 (or baluster coupled thereto) from the bottom rail 462 when an upward force is applied to the baluster connector 1000 or baluster coupled thereto.

As discussed above, in certain aspects, the baluster connectors disclosed herein may be utilized to secure a baluster to a top rail, and/or to a top rail and a bottom rail. For instance, in the aspect depicted in FIG. 11, a railing system 1100 includes the utilization of baluster connectors to couple balusters to a top rail 1140 and to a bottom rail 1120. The top rail 1140 and the bottom rail 1120 can have any or all of the parameters discussed above with reference to the respective top rail 110 and bottom rail 120 of FIG. 1. In the aspect depicted in FIG. 11, the baluster connectors 400 and 400*a* are utilized to connect the baluster 1150 to the bottom rail 1120 and to the top rail 1140, respectively. In aspects, the baluster connectors 400 and 400*a* can have any or all of the properties of the baluster connector 400 discussed above with reference to FIGS. 4A-4C. In alternative aspects not depicted in FIG. 11, other baluster connectors can be utilized, e.g., such as any of the other baluster connectors disclosed herein.

Figure 11:
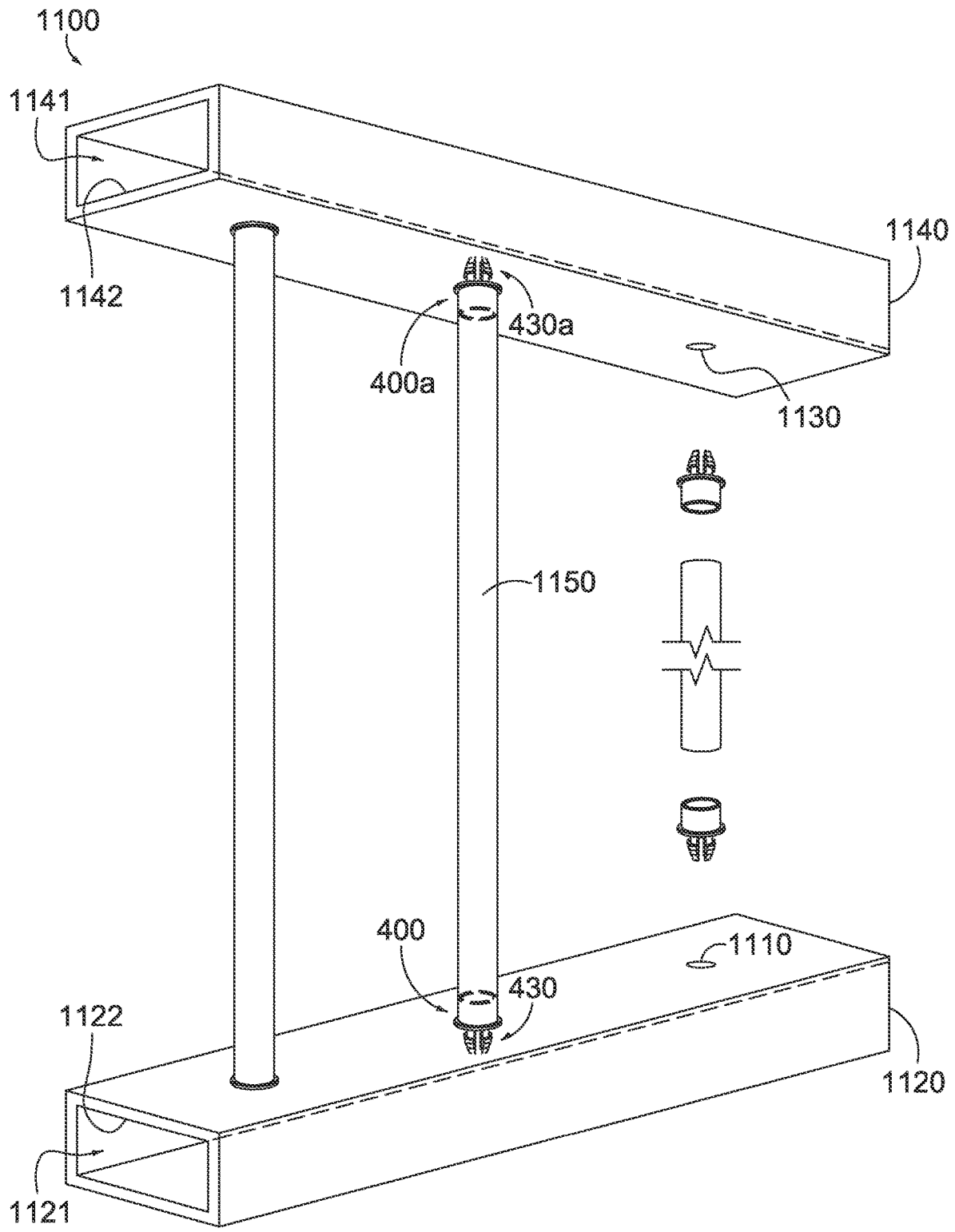
FIG. 11 depicts another example railing system, in accordance with aspects hereof.

In the aspect depicted in FIG. 11, the support engaging portion 430 of the baluster connector 400 can be inserted into an aperture of a bottom rail, e.g., the aperture 1110 of the bottom rail 1120, and extend into a void 1121 of the bottom rail 1120. In such aspects, a portion of the support engaging portion 430, e.g., the portion 433 of one or more of the plurality of spaced apart locking members 432 depicted in FIG. 4A, can interact with an inner surface 1122 of the bottom rail 1120 (and/or a complementary locking member associated with the bottom rail 1120 not depicted in FIG. 11) in order to secure the baluster connector 400 in place and to the bottom rail 1120. In aspects, for example, the portion 433 of the support engaging portion 430 may interact with the bottom rail 1120, e.g., via the inner surface 1122, in such a manner so as to physically prevent disengagement or decoupling of the baluster connector 400 (or baluster 1150 coupled thereto) from the bottom rail 1120 when an upward force is applied to the baluster connector 400 or baluster 1150 coupled thereto.

In the aspect depicted in FIG. 11, the support engaging portion 430*a* of the baluster connector 400*a* can be inserted into an aperture of a top rail, e.g., the aperture 1130 of the top rail 1140, and extend into a void 1141 of the top rail 1140. In such aspects, a portion of the support engaging portion 430*a*, e.g., the portion 433 of one or more of the plurality of spaced apart locking members 432 of the baluster connector 400 depicted in FIG. 4A, can interact with an inner surface 1142 of the top rail 1140 (and/or a complementary locking member associated with the top rail 1140 not depicted in FIG. 11) in order to secure the baluster connector 400*a* in place and to the top rail 1140. In aspects, for example, the portion 433 of the support engaging portion 430*a* may interact with the top rail 1140, e.g., via the inner surface 1142, in such a manner so as to physically prevent disengagement or decoupling of the baluster connector 400*a* (or baluster 1150 coupled thereto) from the top rail 1140 when a downward force is applied to the baluster connector 400*a* or baluster 1150 coupled thereto.

In various aspects, a method for installing a railing system is provided. In one aspect, the method can include inserting a first end of a baluster into an aperture in a top rail. In the same or alternative aspects, the method can include inserting a support engaging portion of a baluster connector into an aperture of a bottom rail, and positioning a second end of a baluster over a baluster engaging portion of the baluster connector. In aspects, positioning the second end of the baluster over the baluster engaging portion can include sliding the baluster upward away from the bottom rail and into a void within the top rail and then back down over the baluster engaging portion of the baluster connector. In various aspects, the method can also optionally include installing a top and/or bottom rail prior to installing the baluster in the top rail; and/or the baluster connector and/or baluster in the bottom rail. In aspects, the railing system and/or components mentioned with respect to the methods of installation described herein can include any or all of the parameters of such components and systems mentioned above with respect to FIGS. 1-10C.

In various aspects, another method for installing a railing system is provided. In aspects, the method can include inserting a baluster engaging portion of a baluster connector into each of a first end and a second end of a baluster. In the same or alternative aspects, the method can include inserting a support engaging portion of each baluster connector into an aperture or void in the top and bottom rails forming a railing segment assembly. In aspects, the method can also include securing the railing segment assembly to one or more posts or supports. In aspects, the railing system and/or components mentioned with respect to the methods of installation described herein can include any or all of the parameters of such components and systems mentioned above with respect to FIGS. 1-11.

The present disclosure can be described in accordance with the following numbered clauses.

Clause 1. A baluster connector, comprising: a first end; a second end opposite the first end; a flange positioned between the first end and the second end; a baluster engaging portion, wherein the baluster engaging portion extends out from the flange to the first end; and a support engaging portion, wherein the support engaging portion extends out from the flange to the second end.

Clause 2. The baluster connector according to clause 1, wherein the second end is adapted to be inserted into a support.

Clause 3. The baluster connector according to clause 2, wherein the support comprises a bottom rail.

Clause 4. The baluster connector according to clause 2, wherein the second end, the support engaging portion, or both, comprise one or more locking members for engaging a portion of the support, a complementary locking member associated with the support, or both.

Clause 5. The baluster connector according to clause 2, wherein an outer surface of the second end, an outer surface of the support engaging portion, or both, comprise one or more ridges adapted to contact at least a portion of the support to provide a friction fit between the support and at least a portion of the baluster connector.

Clause 6. The baluster connector according to any of clauses 1-5, wherein the second end is positioned about 2 millimeters (mm) to about 50 mm, about 3 mm to about 45 mm, or about 4 mm to about 40 mm, from the flange.

Clause 7. The baluster connector according to any of clause 1-6, wherein the first end is positioned about 2 millimeters (mm) to about 50 mm, about 3 mm to about 45 mm, or about 4 mm to about 40 mm, from the flange.

Clause 8. The baluster connector according to any of clauses 1-7, wherein the first end is sized to fit in an interior portion of a baluster.

Clause 9. The baluster connector according to any of clauses 1-8, wherein the baluster engaging portion has a width w1 that is from about 2.5 millimeters (mm) to about 110 mm, from about 5 mm to about 80 mm, from about 6 mm to about 65 mm, or from about 7 mm to about 50 mm.

Clause 10. The baluster connector according to any of clauses 1-9, wherein the support engaging portion has a width w2 that is from about 2 millimeters (mm) to about 45 mm, from about 3 mm to about 40 mm, or from about 4 mm to about 35 mm.

Clause 11. The baluster connector according to any of clauses 1-10, wherein the baluster engaging portion comprises a sidewall extending from the flange to the first end.

Clause 12. The baluster connector according to any of clauses 1-11, wherein the baluster engaging portion exhibits a substantially similar width w1 from a position adjacent or at the first end to a position adjacent the flange.

Clause 13. A railing system, comprising: a top rail, the top rail extending from a first end to a second end; a bottom rail, the bottom rail extending from a first end to a second end, wherein the bottom rail is vertically spaced apart from the top rail; one or more balusters, each of the one or more balusters comprising a first end and a second end; and one or more baluster connectors of any of clauses 1 and 6-12, each of the one or more baluster connectors adapted for coupling to: i) the second end of one of the one or more balusters; and ii) the bottom rail.

Clause 14. The railing system according to clause 13, wherein the first end of each of the one or more balusters is adapted for insertion into at least a portion of the top rail, and wherein the baluster engaging portion of each of the one or more baluster connectors extends out from the flange to the baluster connector first end a distance that is equal to or greater than a distance the baluster first end can travel within a void of the top rail, when the railing system is in an assembled configuration.

Clause 15. The railing system according to clause 13 or 14, wherein, when the railing system is in an assembled configuration, the support engaging portion of each of the one or more baluster connectors comprises one or more locking members that engage at least a portion of the bottom rail, a complementary locking member associated with the bottom rail, or both.

Clause 16. The railing system according to any of clauses 13-15, wherein, when the railing system is in an assembled configuration, an outer surface of the support engaging portion of each of the one or more baluster connectors comprises one or more ridges adapted to contact at least a portion of the bottom rail to provide a friction fit within the at least a portion of the bottom rail.

Clause 17. The railing system according to any of clauses 13-16, wherein an outer surface of the flange contacts an outer surface of the bottom rail, when the railing system is in an assembled configuration.

Clause 18. The railing system according to any of clauses 13-17, wherein the baluster engaging portion of each of the one or more baluster connectors is positioned at least partly in an interior portion of a baluster of the one or more balusters, when the railing system is in an assembled configuration.

Clause 19. The railing system according to any of clauses 13-18, wherein the support engaging portion of each of the one or more baluster connectors is positioned in a void in the bottom rail, when the railing system is in an assembled configuration.

Clause 20. The railing system according to any of clauses 13-19, wherein the railing system is adapted for installation on a level surface, an angled surface, or a combination thereof.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

While specific elements and steps are discussed in connection to one another, it is understood that any element and/or steps provided herein is contemplated as being combinable with any other elements and/or steps regardless of explicit provision of the same while still being within the scope provided herein. Since many possible embodiments may be made of the disclosure without departing from the scope thereof, it is to be understood that all matter herein set forth or shown in the accompanying drawings is to be interpreted as illustrative and not in a limiting sense.

What is claimed is:

1. A railing system, comprising:

a top rail, the top rail extending from a first end to a second end;

a bottom rail, the bottom rail extending from a first end to a second end, wherein the bottom rail is vertically spaced apart from the top rail, and wherein the bottom rail includes a first surface vertically spaced apart from a second surface, the first surface having an outer surface, the outer surface of the first surface facing the top rail, and an opposing inner surface, the inner surface of the first surface facing the second surface;

one or more balusters, each of the one or more balusters comprising a first end and a second end;

one or more baluster connectors comprising:

a first end;

a second end opposite the first end;

a flange positioned between the first end and the second end;

a baluster engaging portion, wherein the baluster engaging portion extends out from the flange to the first end;

a support engaging portion, wherein the support engaging portion extends out from the flange to the second end, an outer surface of the support engaging portion comprising one or more circular ridges; and when in an assembled configuration the one or more circular ridges of the outer surface of the support engaging portion are in contact with at least a portion of the first surface of the bottom rail.

2. The railing system according to claim 1, wherein the first end of each of the one or more balusters is adapted for insertion into at least a portion of the top rail, and wherein, when the railing system is in the assembled configuration, the baluster engaging portion of each of the one or more baluster connectors extends out from the flange to the first end of the one or more baluster connectors a first distance that is equal to or greater than a second distance the first end of the one or more balusters can vertically shift within a void of the top rail.

3. The railing system according to claim 1, wherein, when the railing system is in the assembled configuration, the support engaging portion of each of the one or more baluster connectors comprises one or more locking members in contact with the inner surface of the first surface of the bottom rail.

4. The railing system according to claim 1, wherein an outer surface of the flange is in contact with the outer surface of the first surface of the bottom rail, when the railing system is in the assembled configuration.

5. The railing system according to claim 4, wherein the baluster engaging portion of each of the one or more baluster connectors is positioned at least partly in an interior portion of a baluster of the one or more balusters, when the railing system is in an assembled configuration.

6. The railing system according to claim 5, wherein the support engaging portion of each of the one or more baluster connectors is positioned between the first surface of the bottom rail and the second surface of the bottom rail, when the railing system is in the assembled configuration.

7. The railing system according to claim 1, wherein the railing system is adapted for installation on a level surface, an angled surface, or a combination thereof.

* * * * *